US007815050B2

(12) United States Patent
Martin et al.

(10) Patent No.: US 7,815,050 B2
(45) **Date of Patent: *Oct. 19, 2010**

(54) FLEXIBLE SNACK PACKAGE WITH FINGER WIPING FEATURE

(75) Inventors: Richard K. Martin, Chattanooga, TN (US); R. Gordon Bentley, Athens, TN (US)

(73) Assignee: McKee Foods Kingman, Inc., Kingman, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/198,455

(22) Filed: Aug. 26, 2008

(65) Prior Publication Data

US 2008/0314787 A1 Dec. 25, 2008

Related U.S. Application Data

(63) Continuation-in-part of application No. 11/546,724, filed on Oct. 12, 2006.

(51) Int. Cl.
*B65D 85/00* (2006.01)

(52) U.S. Cl. ..... 206/542; 206/548; 206/812; 206/541; 383/105; 383/107

(58) Field of Classification Search ..... 206/542, 206/210, 581, 233, 494, 812, 541, 548, 216; 383/105, 107, 127
See application file for complete search history.

(56) References Cited

U.S. PATENT DOCUMENTS 2,260,064 A * 10/1941 Stokes ..... 53/415
2,723,936 A * 11/1955 Ryan ..... 156/209
3,057,539 A * 10/1962 Leary, Jr. ..... 383/206
3,291,377 A * 12/1966 Eggen ..... 426/122
3,320,073 A * 5/1967 Bixby, Jr. et al. ..... 426/433
3,499,538 A 3/1970 Sherard
3,926,361 A 12/1975 Hilderbrand
4,337,812 A 7/1982 Trinkner
4,428,477 A * 1/1984 Cristofolo ..... 206/210
4,482,648 A 11/1984 Norman
4,484,350 A 11/1984 Gordon
4,765,477 A * 8/1988 Froidh et al. ..... 206/438
4,812,486 A 3/1989 Hosokawa et al.
4,941,756 A 7/1990 Price (Continued)

FOREIGN PATENT DOCUMENTS

JP 11246710 A * 9/1999

(Continued)

OTHER PUBLICATIONS

Ink Technology, Foaming ink has BAWLS bouncing into new markets, Packaging Digest, Dec. 2006, pp. 42 and 43.

*Primary Examiner*—David T Fidei
(74) *Attorney, Agent, or Firm*—Womble Carlyle Sandridge & Rice, PLLC

(57) ABSTRACT

A combination product/napkin package is provided. A package includes a product wrapper and a finger wiping patch. The product wrapper comprises a sheet of flexible film that is foldable around the product and has edges sealable around a periphery to enclose and seal the product therein. The finger wiping patch is a textured surface of foaming ink absorbent resin, tacky resin, or a textured material applied to the wrapper at a position outside the sealed product.

10 Claims, 8 Drawing Sheets

U.S. PATENT DOCUMENTS

| | | | | | |
|---|---|---|---|---|---|
| 4,949,846 | A | * | 8/1990 | Lakey | 206/484 |
| 4,991,980 | A | | 2/1991 | Cohen et al. | |
| 5,076,040 | A | * | 12/1991 | Davis | 53/551 |
| 5,256,417 | A | * | 10/1993 | Koltisko | 424/402 |
| 5,567,744 | A | | 10/1996 | Nagata et al. | |
| 5,584,166 | A | * | 12/1996 | Lakey | 53/451 |
| 5,590,783 | A | | 1/1997 | Capy et al. | |
| 5,620,256 | A | * | 4/1997 | Makrauer | 383/5 |
| 5,736,224 | A | * | 4/1998 | Dodge | 428/156 |
| 5,826,985 | A | * | 10/1998 | Goodman et al. | 383/200 |
| 6,007,264 | A | * | 12/1999 | Koptis | 401/132 |
| 6,641,306 | B1 | | 11/2003 | Knoerzer et al. | |
| 6,808,072 | B2 | | 10/2004 | Snedeker et al. | |
| 7,135,449 | B2 | * | 11/2006 | Li et al. | 510/278 |
| 7,250,459 | B2 | | 7/2007 | Dairoku et al. | |
| 2002/0043473 | A1 | * | 4/2002 | Lee et al. | 206/217 |
| 2003/0223653 | A1 | * | 12/2003 | Knoerzer et al. | 383/40 |
| 2004/0118431 | A1 | * | 6/2004 | Flynn | 134/6 |
| 2005/0259894 | A1 | | 11/2005 | Swartz et al. | |
| 2006/0126975 | A1 | * | 6/2006 | McKellar | 383/200 |

FOREIGN PATENT DOCUMENTS

| | | |
|---|---|---|
| WO | WO/02/38029 | 5/2002 |

* cited by examiner

FLEXIBLE SNACK PACKAGE WITH FINGER WIPING FEATURE

RELATED APPLICATIONS

This is a continuation-in-part of application Ser. No. 11/546,724, filed Oct. 12, 2006, the content of which is hereby incorporated in its entirety.

FIELD OF THE INVENTION

The present invention relates generally to product packages such as food packages, and more particularly, to a product package incorporating a napkin or other finger wiping patch as a part thereof.

BACKGROUND OF THE INVENTION

For many years, products such as snack foods have been individually packaged by conventional form, fill, and seal packaging machines in the snack food industry. Snack foods are many, and include items such as candy bars, sweet rolls honey buns, doughnuts, etc. Improved packaging technology over the years has ensured both the freshness and purity of food items enclosed therein. For example, human contact/handling of food items has been almost completely eliminated by the automated packaging machinery of recent years.

Typically, individually packaged snacks today are packaged in flexible films that are fed from rolls of flexible sheet material to form tubes for receiving individual product servings being delivered at high speeds. The individual servings are then separated by heat-sealing mechanisms that seal the individual packages in the longitudinal and transverse (top and bottom) positions. The individual packages are subsequently packaged in bulk and stored/shipped for subsequent sale and consumption.

Individually packaged snack food items are usually consumed by persons who are away from home and on-the-go. As such, these consumers typically do not have napkins or other wiping items available while eating the snack items. Unfortunately, some snack items such as honey buns, cinnamon buns, doughnuts and other pastries have glazing or sticky coatings. As a result, consumers get "sticky" fingers and lack any means to wipe them or wash them.

SUMMARY OF THE INVENTION

The present invention is directed to a combination product package and napkin or other finger cleaning or wiping patch for a snack food that satisfies the need for a readily available napkin, towelette, or other finger cleaning means for persons consuming snack food items in their car or "on the go." While this specification describes the invention with respect to food items, it is apparent that it may be applicable to non-food items that may be similarly packaged; but use of the product therein makes the availability of the finger cleaning patch desirable.

Some of the embodiments described herein are formed from a singular sheet of film having a main portion bounded by a seal area or margin which extends along the opposed ends, down one side, and along a path parallel to, but spaced apart from, the other side. In two of the embodiments a flap, having a napkin attached thereto, extends outwardly from at least one of the opposed edges of the sheet.

In general, the invention is directed to a combination product package (snack food)/napkin including a product wrapper and a napkin or other finger cleaning or wiping patch. As used herein the word "patch" includes a material that is applied to the package film or a surface area that has been altered to serve the finger cleaning function. The product package is a flexible film wrapper around the product in sealing relation thereto. The napkin is affixed or attached in some manner to the outside of the wrapper, yet is covered so that it is protected from external contaminants, etc. Alternatively, a textured surface created by the application of an ink, ink system, absorbent resin, tacky resin, or other textured material and/or surface altering process is applied to a similar portion of the wrapper and serves in a napkin-like or finger cleaning capacity. The napkin, ink, resin, or textured surface serves as a surface for the user to wipe his/her fingers to rub off sticky residue. Preferably, a tear strip is provided along one edge of the package to facilitate opening.

In one embodiment, the wrapper is formed from a sheet of flexible film such as oriented polypropylene, cellophane, or the like. When formed, the package has a front wall, a rear wall, and a width. As is conventional in the packaging arts, a longitudinal seal is formed on the rear wall and extends between the opposed ends of the package. Transverse seals extend are formed at the opposed ends of the package to complete the packaging of the snack item. A flap formed as an extension of the flexible film extends outwardly from the longitudinal seal on the rear wall of the package. In the embodiment described herein, the flap extends lengthwise between the opposed ends of the package and is sealed or otherwise attached at each end by the transverse seals at the opposed ends. Thus, the flap has an inner surface area overlying a portion of the rear wall of the package and a free edge forming a pocket between the flap and the package. A napkin is affixed to at least some portion of the inner surface of the flap so that a consumer can insert his or her fingers between the rear wall and the inner surface of the flap to wipe them clean of residue from the snack.

In a second embodiment, the wrapper is similarly formed from a sheet of flexible film, having a front wall, a rear wall, and a width, with similar longitudinal and transverse seals. As is conventional in the packaging arts, a longitudinal seal is formed on the rear wall and extends between the opposed ends of the package. Transverse seals extend are formed at the opposed ends of the package to complete the packaging of the snack item. A pair of overlying flaps extend outwardly from the longitudinal seal and lengthwise between the opposed ends. The opposed flaps that are formed as extensions of the flexible film extend outwardly from the longitudinal seal on the rear wall of the package, having facing inner surfaces and free outer edges. A napkin is affixed to at least some portion of the inner surface of each of the overlying flaps so that a consumer can spread open the opposed flaps and wipe his or her fingers on the exposed napkin.

In yet another embodiment, the wrapper is similarly formed of the same flexible sheet material, encapsulating a napkin or towelette that is affixed by bonding or adhesive to either the front or rear wall of the package so that a consumer may easily access the napkin.

In still another embodiment of the package, the flexible film sheet is extended lengthwise of the wrapper so that a separate compartment may be formed for containing the napkin apart from the product compartment.

In a recent improvement, it has been found that a foaming ink, absorbent resin, tacky resin, or textured patch can be applied to the aforementioned flap(s), or onto another appropriate area of the wrapper whereby the folding and affixing of a separate paper napkin is obviated.

These and other aspects of the present invention will become apparent to those skilled in the art after a reading of the following description of the preferred embodiment in combination with the figures.

DESCRIPTION OF THE PREFERRED EMBODIMENT

Figure 1:
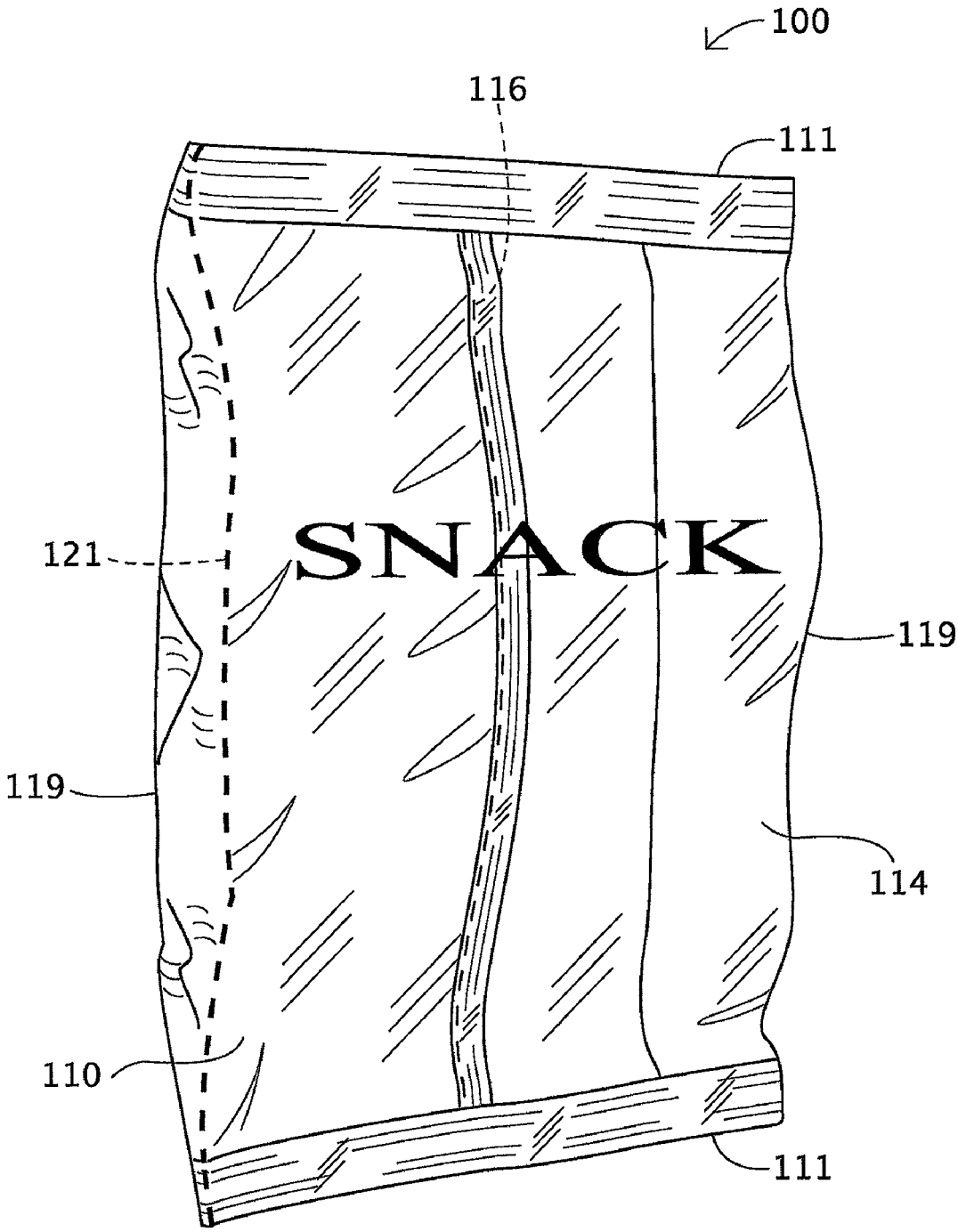
FIG. 1 is a front perspective view of one embodiment of the package of the present invention.

Referring to the Figures in general, and to FIGS. 1 through 4 in particular, one embodiment of the present invention is directed to combination product/napkin package. The package, shown generally as 100, comprises a flexible product wrapper 110 and a napkin 150. Again, it should be understood that while a food package is specifically described herein, other product packages that can be commercialized with a napkin are within the scope of the present invention.

The product wrapper 110 is formed from a generally rectangular singular sheet 109 of flexible film having opposed ends 111 that define the length of the package,and opposed sides 113. The sheet 109 includes a main portion 103 and a marginal area 107 which forms the seals after the package is formed. The package formed therefrom includes a front wall 114, a rear wall 115, opposed sides edge 119, and a width. To seal the product within the package wrapper 110, a longitudinal seal 116 extends lengthwise between the opposed ends 111 to enclose the film 109 around the product, such as a honey bun or other food item. Transverse seals 117 extend acrossthe width of the package 100 at the opposed ends 111 to completely seal the product within the package 100. A tear strip 121 is formed by conventional and well known construction along one side to provide easy access to the contents without destroying the seal 116 for reasons to become apparent.

In the first embodiment shown in FIGS. 1 through 4, the continuous sheet 109 of flexible film is formed from oriented polypropylene, cellophane, polyester, or the like film material. As will be appreciated, the continuous sheet forming the wrapper 110 is cut from a large roll during the actual assembly line packaging process. Such packaging assembly equipment is available from any number of packaging machine manufacturers, such as Tevopharm from Bosch of the Netherlands. Again, the sheet 109 contains a main portion 103 and a marginal area seal area 107 which extends along the opposed ends 111, down one side 113, and along a path parallel to, but spaced apart from, the other side 113, which defines a flap 118 as later described. The manner in which the film wraps around and encloses and seals the food product is conventional and will not be repeated herein.

Figure 2:
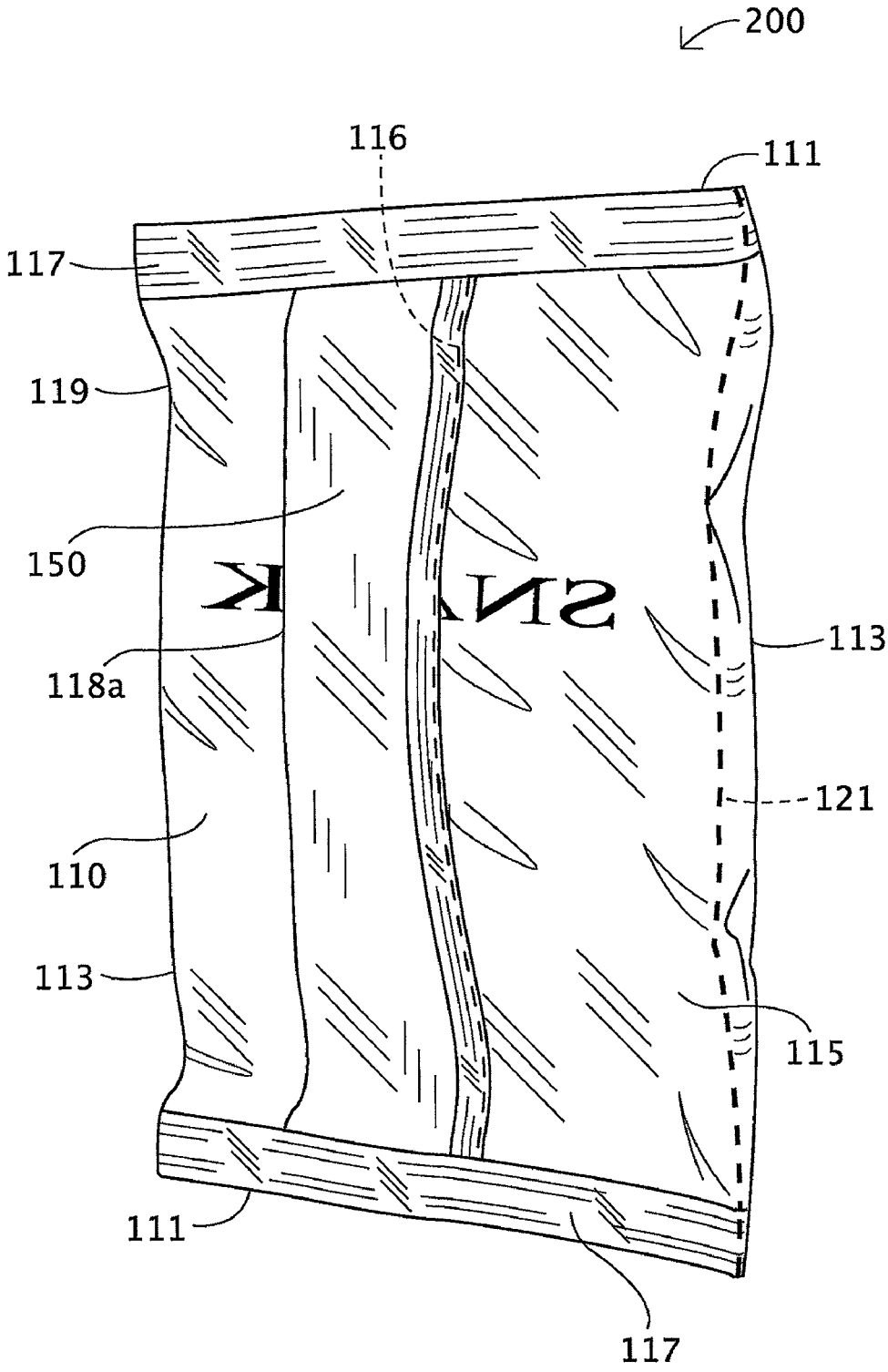
FIG. 2 is a rear perspective view of the package of FIG. 1.
Figure 3:
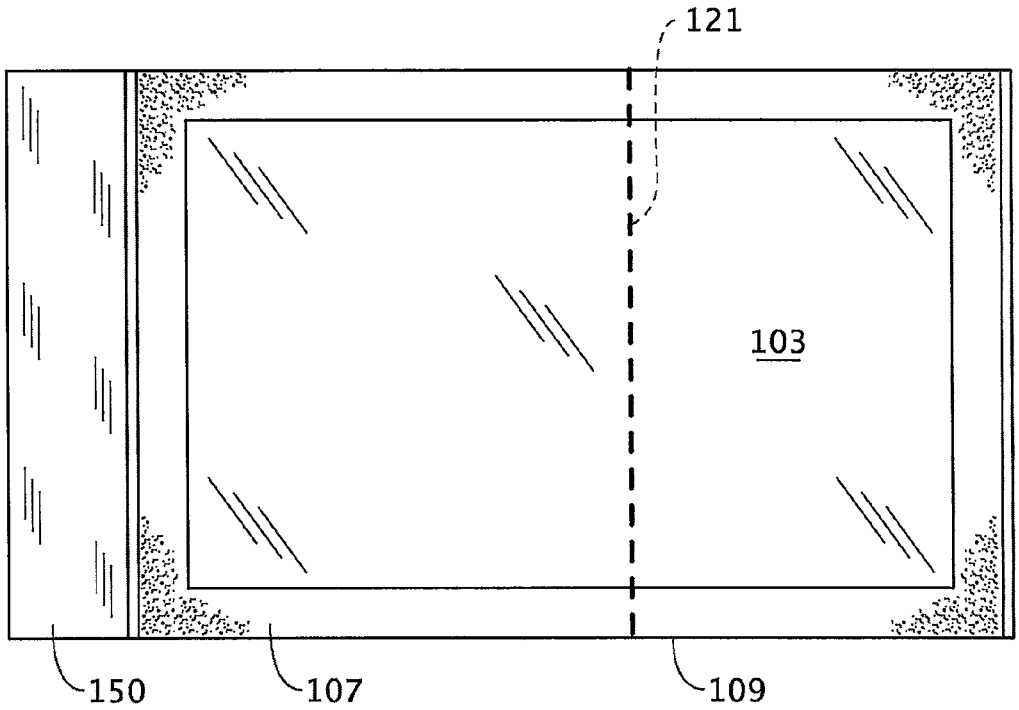
FIG. 3 is a plan view of the inner surface of the sheet of flexible film suitable for use in forming the package of FIGS. 1 and 2.

In the embodiment shown in FIGS. 1 through 4, the sheet 109 of the flexible film 110 further comprises flap 118 that extends outwardly from the longitudinal seal 116 to a free edge 118*a* and lengthwise between the opposed ends 111. As will be appreciated, the flexible sheet 109 is dimensioned so that the flap 118 is part of the continuous sheet which extends beyond the seal area 116. The flap 118 is joined or bounded at the opposed ends 111 by the transverse seals 117. As will also be appreciated, the longitudinal and transverse seals 116, 117 formed in marginal areas 107 may be either heat sealed by the conventional packaging machines or may be cold sealed with a suitable adhesive applied to the film, as illustrated in FIG. 3. The manner of forming the seals is well known in the art and not critical to the present invention.

Figure 4:
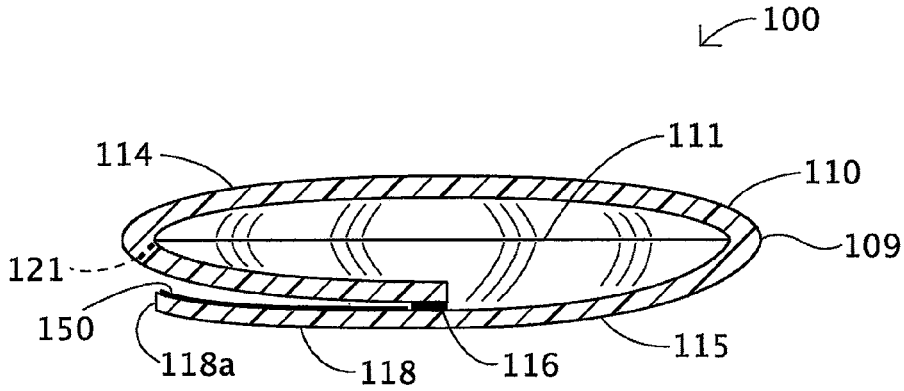
FIG. 4 is a schematic cross-sectional view of the package of FIGS. 1 and 2.

As best shown in FIGS. 2 and 4, a napkin 150 is affixed at the ends thereof to the inwardly facing surface of the flap 118 so that the napkin 150 is not directly exposed to outer contact or contaminants from normal handling of the package 100. The napkin 150 may be formed of any suitable paper, or fabric, stock suitable for napkins and similar sanitary items. Alternatively, the napkin 150 may be in the form of a towelette, as desired; however, the material of the napkin 150 may be varied depending upon the type of snack item enclosed in the package 100, etc. Further, while the napkin 150 in the embodiment shown in FIG. 3 extends the entire length of the flap 118, and is affixed at the ends only, it may be affixed to some other portion of the inner surface of the flap 118 and is affixed at the ends only. The napkin 150 may be adhesively bonded to the film, or alternatively, the napkin 150 may embody an adhesive within the composition of the napkin 150 that can be sprayed or layered over the film to form the napkin 150.

With the flap 118 and napkin 150 formed as shown in FIGS. 1 through 4, and because of the free edge 118*a*, the napkin 150 is easily accessible for a consumer of the snack to insert their fingers beneath the flap without having to break any of the seals 116, 117 of the package 100. To facilitate opening of the package 100 itself, a tear strip 121 is preferably formed in the wrapper 110 so that it is conveniently located when the wrapper 110 is folded around the snack. As shown in the Figures, the tear strip 121 formed according to conventional techniques is located adjacent one of the opposed side edges of the folded wrapper 110.

Figure 5:
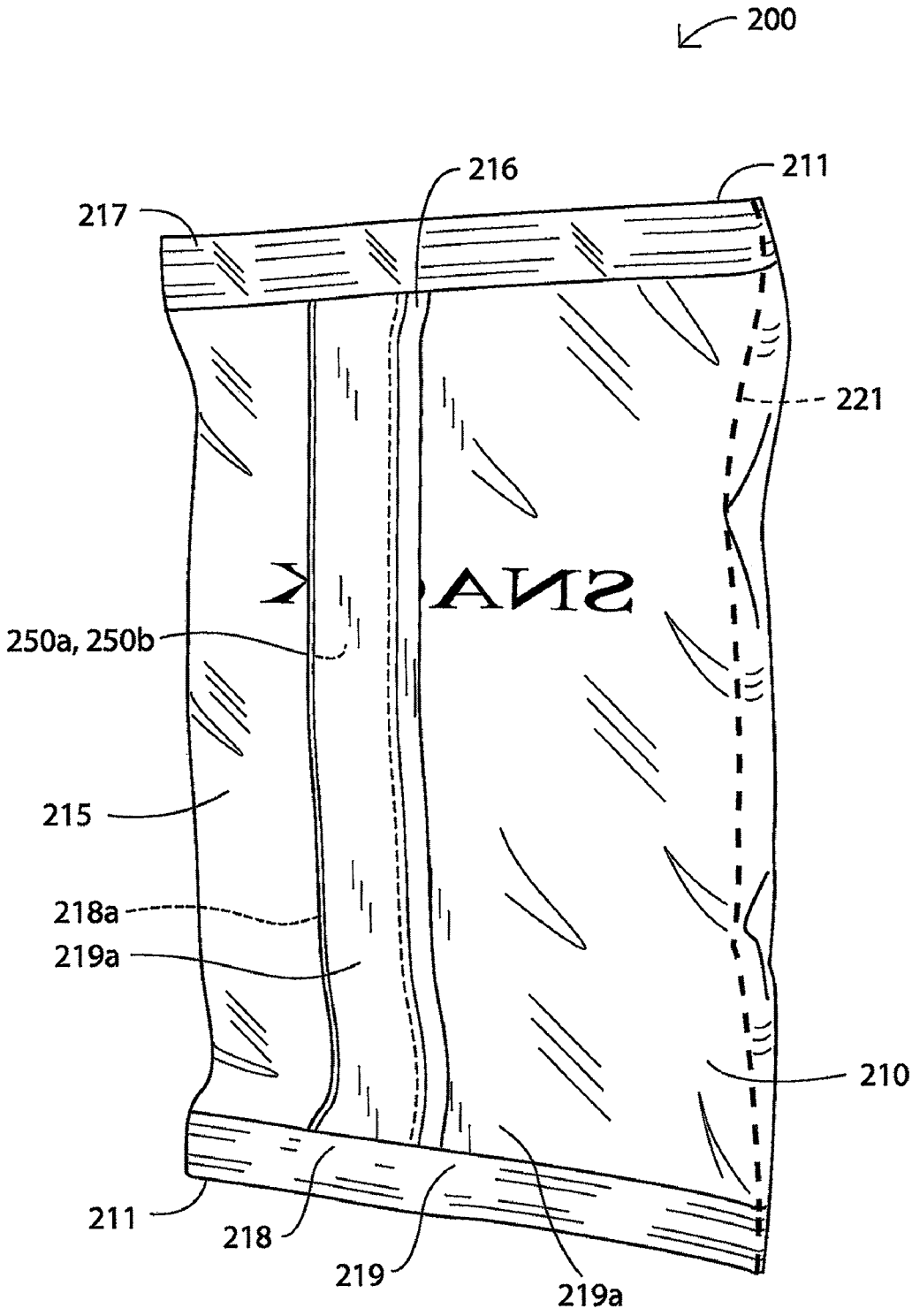
FIG. 5 is a rear perspective view of a second embodiment of the package of the present invention.
Figure 6:
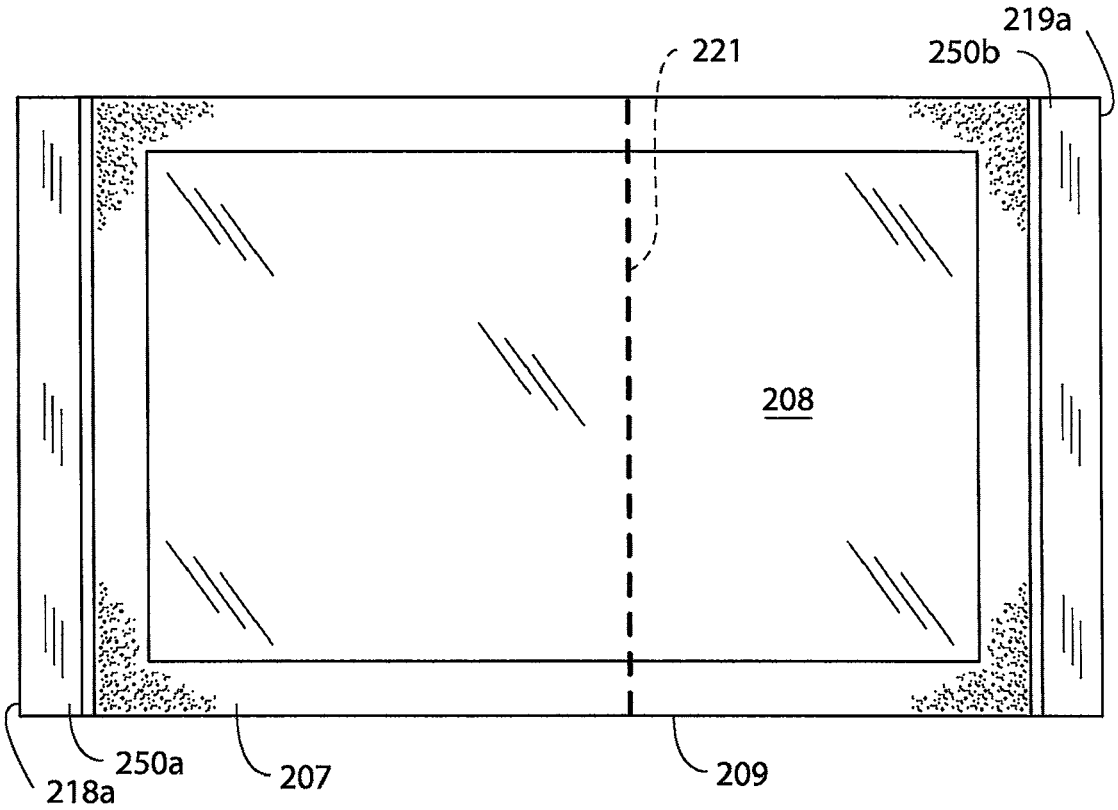
FIG. 6 is a plan view of the inner surface of the sheet of flexible film suitable for use in forming the package of FIG. 5.
Figure 7:
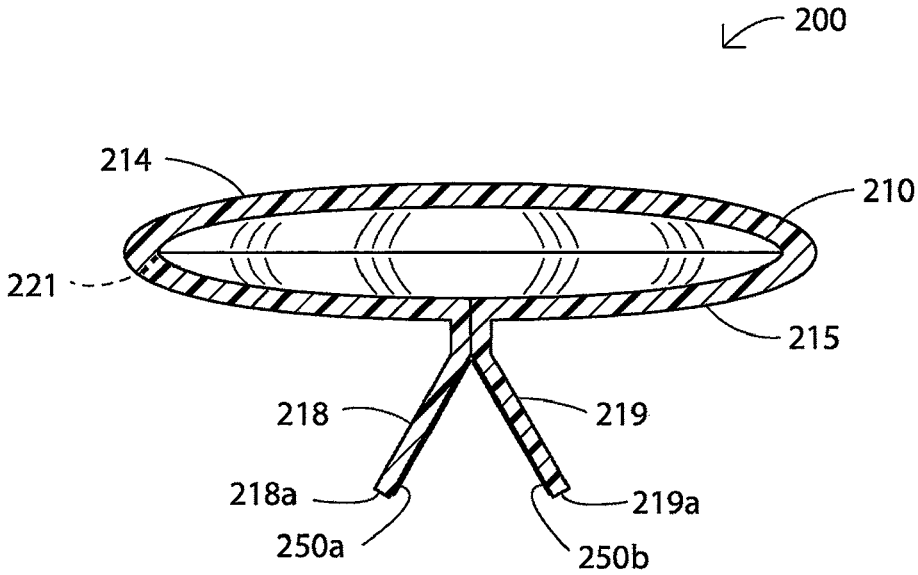
FIG. 7 is a schematic cross-sectional view of the package of FIG. 4.

Turning now to FIGS. 5 through 7, a second embodiment 200 of the combination package of the present invention is shown. This embodiment of the combination package 200 comprises the same flexible film in a continuous sheet as the first embodiment 100 described above. The sheet 209 includes a main portion 208 and a marginal seal area 207. The sheet 209 of the flexible film 210 further comprises a pair of flaps 218, 219 that extend outwardly from the longitudinal seal 216 to a free edges 218*a*, 219*a* and lengthwise between the opposed ends 211. As will be appreciated, the flexible sheet 209 is dimensioned so that the flaps 218, 219 are part of the continuous sheet which extends beyond the seal area 216. The package 200 also comprises the same longitudinal 216 and transverse 217 seals as described above to enclose and seal the snack within the wrapper 210. As best seen in FIG. 5, however, a pair of flaps 218, 219 extend outwardly from the longitudinal seal 216 when the wrapper 210 is folded around the product. The flaps 218, 219 comprise opposite ends of the unfolded wrapper 210. The flaps 218, 219 extend lengthwise between the opposed ends 211 of the package 200, but are not necessarily joined by the transverse seals 217 at opposed ends 211 of the package 200. As shown in FIGS. 5 and 7, the flaps 218, 219 may extend outwardly generally perpendicular to the rear wall 215, or alternatively be folded downwardly against the rear wall 215. At least some portion of the inwardly, overlying surfaces of the flaps 218, 219*e* each have a napkin 250*a*, 250*b* affixed thereto. As the flaps 218, 219 have free ends 218*a*, 219*a*, a consumer may readily spread the two flaps 218, 219 apart to access a larger napkin surface for wiping of the fingers. Again, a tear strip 221 is located adjacent one of the opposed side edges 219 of the folded wrapper 210 is provided.

Figure 8:
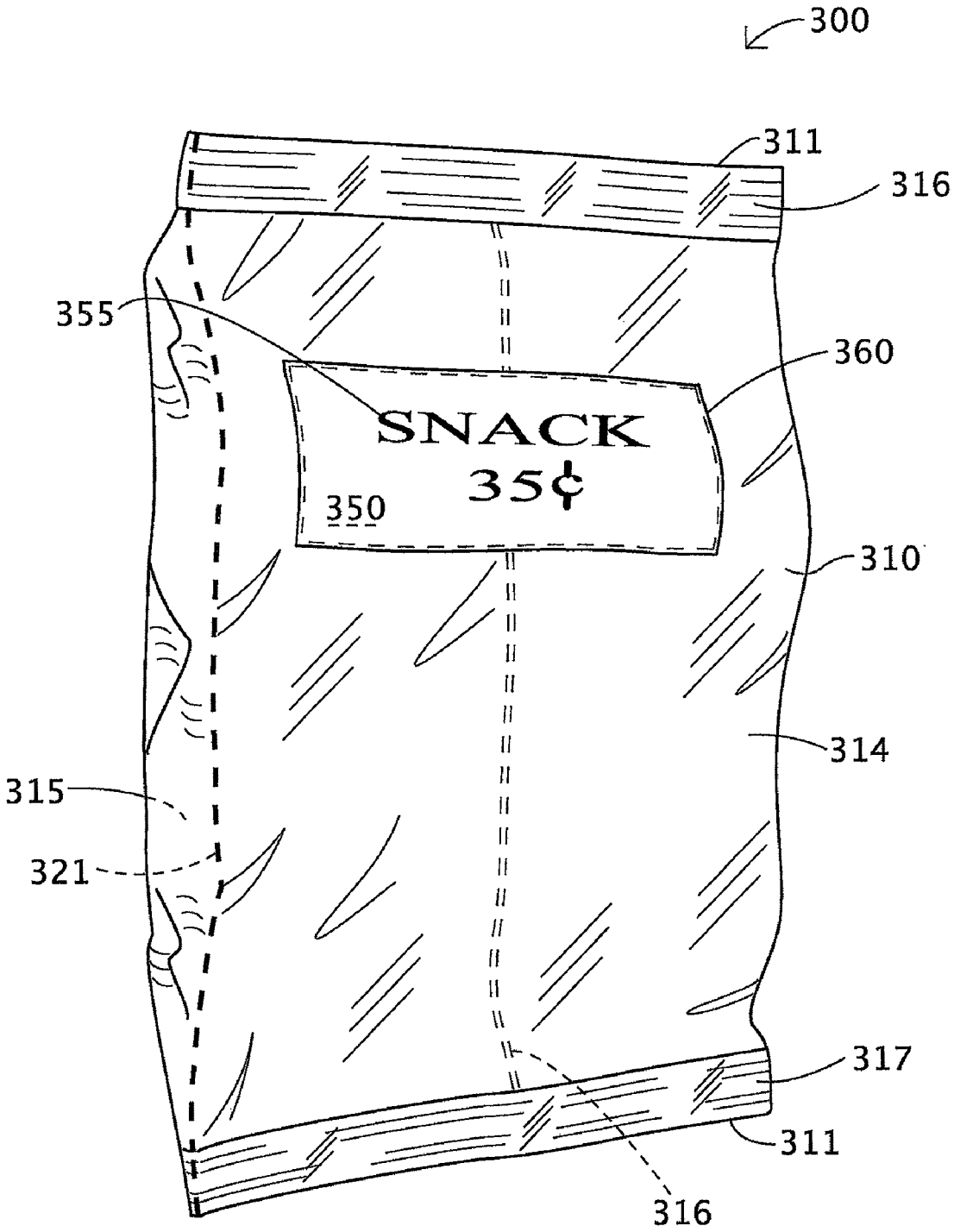
FIG. 8 is a front perspective view of a third embodiment of the package of the present invention.

Turning now to FIG. 8, a third embodiment of the combination package 300 is illustrated. The package 300 of flexible film is constructed similar to the embodiments described above with longitudinal 316 and transverse seals 317 which enclose and seal the product within the package 300. Unlike the previous embodiments, the napkin 350 of this embodiment is encapsulated in a separate packet 360 formed of the same or similar flexible sheet material of which the wrapper 310 is formed. As will be appreciated, there are numerous ways in which a packet 360 may be separately formed with a folded napkin sealed therein. The packet 360 may be heat or cold sealed to either the front wall 314 or rear wall 315, as desired for the particular product package. Further, as the flexible film is transparent, indicia 355, such as the product name or price, may be printed or colored on the napkin 350 so that it is outwardly visible to a consumer. In this manner, the napkin 350 serves multiple purposes. Alternatively, in lieu of a separate packet 360 for encapsulating the napkin, a layer of flexible film may be laminated over the top of the napkin 350 that is placed directly adjacent the front wall 314 or rear wall 315 surface.

Figure 9:
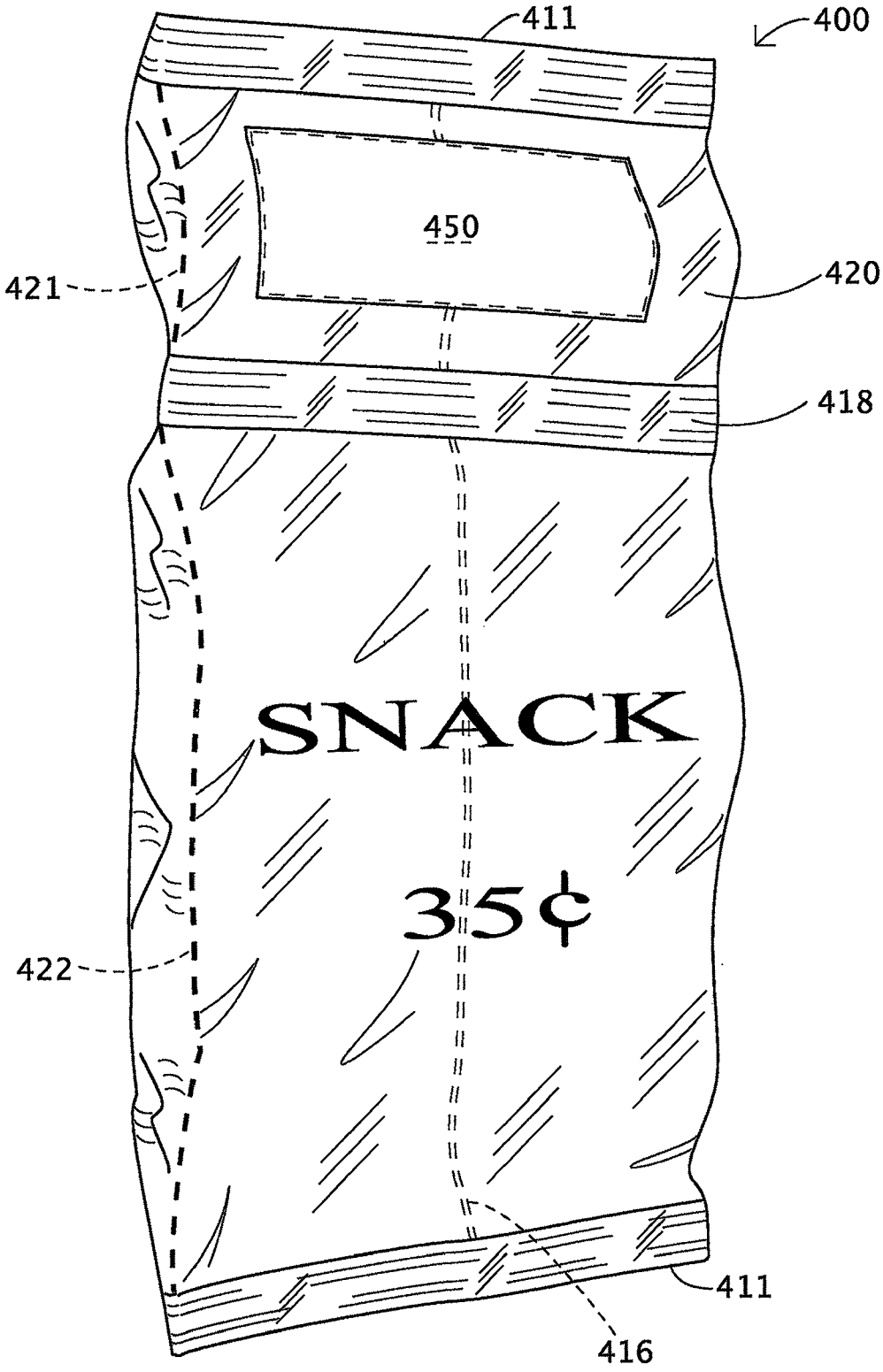
FIG. 9 is a front perspective view of a fourth embodiment of the flexible package of the present invention.

According to FIG. 9, yet another embodiment of the package 400 of the present invention is shown. This package of flexible film is constructed from a singular sheet of flexible film with the same type of longitudinal seal 416 described above. In this embodiment, however, the sheet may have a greater length that the sheets described above so that a separate compartment 420 may be formed for containing a napkin 450. As shown in the Figure, transverse seals 411 enclose and seal the product, and a third transverse seal 418 encloses and seals a napkin 450 in a separate compartment. Tear strips 421 and/or 422 may be incorporated into the flexible sheet material to facilitate opening of the product compartment and/or the napkin compartment.

Figure 10:
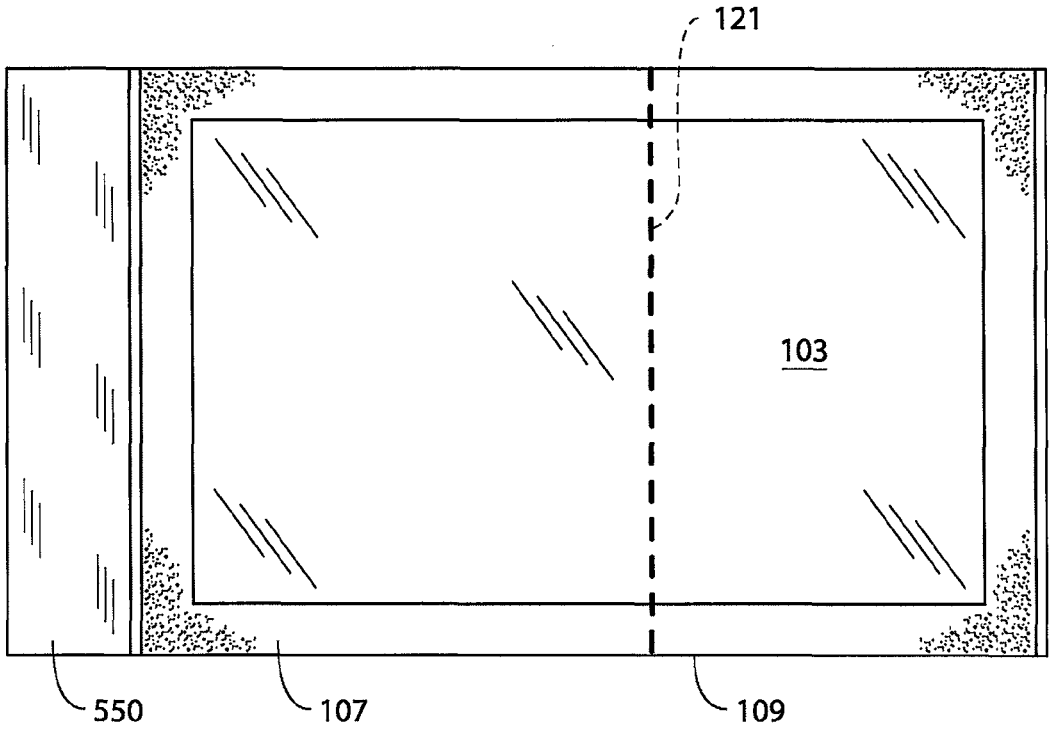
FIGS. 10 and 11 are views similar to FIGS. 3 and 4, except illustrating the manner in which the wiping patch replaces the napkin.
Figure 11:
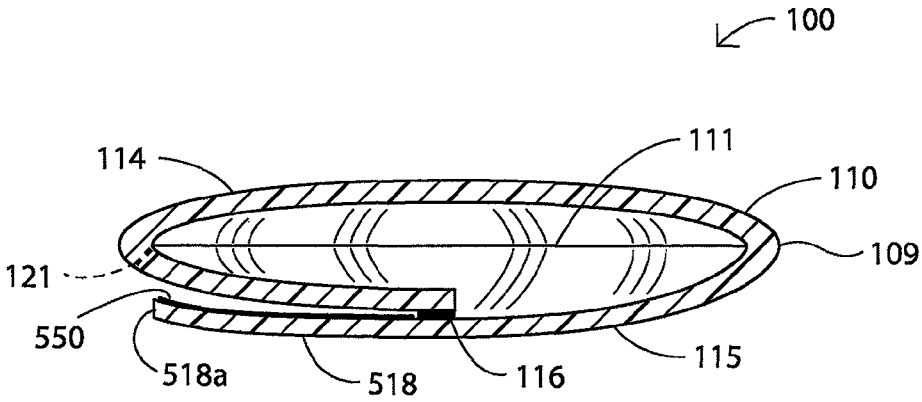

As illustrated in FIGS. 10 and 11, the composition is printed onto the inner surface of flap 518 in the place of napkin 150 to form a finger wiping patch 550. The patch may be affixed onto flap 518 at an appropriate time during the processing of the film package. Further, the patch may be applied to other areas, such as onto both flaps, as in FIGS. 5-7. Other portions of the wrapper are the same as described with respect to FIGS. 3 and 4.

Examples of such a cleaning composition include a foaming ink produced by INX International Ink corporation of Schaumberg, Ill. or any of various absorbent resins including, but not limited to the crosslinking products of polyacrylic acid salt, vinyl alcohol-acrylate copolymers, polyvinyl alcohols grafted with maleic anhydride, acrylate polymers, starch-acrylonitrile graft copolymers and graft polymers, starch-acrylic acid graft polymer, starch-acrylate graft copolymers, acrylonitrile copolymers, acrylamide copolymers, acrylate-methacrylate copolymers, vinyl acetate-acrylic ester copolymers, vinyl acetate-acrylate copolymer, isobutylene-maleic anhydride copolymer, carboxymethyl cellulose, carboxymethyl cellulose polymers, isobutyrene-maleic anhydride copolymers, methyl acrylate-vinyl acetate copolymers, as well as the neutralized acids, partially neutralized acids, hydrolyzed copolymers and saponified polymers and copolymers thereof, alone, or in combination. Other suitable resins include, but are not limited to, resins resulting from reversed-phase suspension homopolymerization or copolymerization of water-soluble ethylenic unsaturated monomers including acrylic acid, methacrylic acid, 2-acrylamide-2-methylpropanesulfonic acid, and 2-methacrylamide-2-methylpropanesulfonic acid; monomers such as acrylamide, methacrylamide, N,N-dimethylacrylamide, 2-hydroxyethyl acrylate, 2-hydroxyethyl methacrylate, N-methylol acrylamide and N-methylol methacrylamide; amino-containing unsaturated monomers such as diethylaminoethyl acrylate, diethylaminoethyl methacrylate, diethylaminopropyl acrylate, diethylaminopropyl methacrylate, diethylaminopropyl acrylamide and diethylaminopropyl methacrylamide, and quaternary compounds as well as combinations thereof.

Suitable tacky or weakly adhesive resins such as polyvinyl chlorides mixed with a plasticizer, plasticized neoprene, polysulfides, polyurethanes, and acrylics such as butyl acrylate may also be used as the finger wiping patch. Alternatively the patch might be formed as a knurled, embossed, or otherwise textured surface area or patch of polymeric material. The patch may be printed, laminated, sprayed on, coated, or according to any other conventional techniques for applying such a patch to a film. The prescribed area can even be subjected to a surface altering process (embossing, knurling, etc.).

It should be recognized that the preferred embodiment described above is exemplary only. Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A combination product wrapper/finger cleaning package, comprising:

(a) a product wrapper and a finger wiping patch;

(b) the product wrapper, comprising:

(i) a sheet of generally rectangular flexible film foldable around a product and having edges sealable around a periphery to enclose and seal the product therein, and having opposed ends defining a length therebetween bounded by opposed sides, the package formed therefrom having a front wall, a rear wall, ends defining a length and sides defining a width ;

(ii) a longitudinal seal extending lengthwise along a path parallel to and between the opposed sides and sealing one of the opposed sides along a path spaced from but adjacent to the opposite side;

(iii) a transverse seal extending across the width of the package at each of the opposed ends;

(iv) a flap extending outwardly from said longitudinal seal, the flap being joined at the opposed ends to the transverse seals, the flap having an inner surface and an outer free edge; and (c) the finger wiping patch comprising a textured surface selected from the group consisting of foaming ink, absorbent resins, tacky resins, and textured material being applied to the wrapper at a position outside the product wrapper, the finger wiping patch being covered to prevent exposure to contaminants, the textured surface being on at least some portion of the inner surface of the flap adjacent the surface of the wrapper, wherein the composition forms the finger wiping patch which is accessible to a consumer of the product, beneath the flap without breaking a seal.

2. The package of claim 1 wherein the package further comprises opposed side edges and wherein a tear strip is formed adjacent one of the opposed side edges of the package.

3. The package of claim 1 wherein the wrapper and the flap are formed from a single sheet of flexible material.

4. The package of claim 1 wherein the flexible sheet material is selected from the group consisting of polypropylene, cellophane, polyester, and combinations thereof.

5. The package of claim 4 wherein the flexible sheet material comprises an inner surface having a metallized layer affixed thereto at least some portion thereof.

6. A combination product wrapper/finger cleaning package, comprising:

(a) a product wrapper and a finger wiping patch;

(b) the product wrapper, comprising:

(i) a sheet of generally rectangular flexible film foldable around a product and having edges sealable around a periphery to enclose and seal the product therein, and having opposed ends defining a length therebetween bounded by opposed sides, the package formed therefrom having a front wall, a rear wall, ends defining a length and sides defining a width ;

(ii) a longitudinal seal extending lengthwise along a path parallel to and between the opposed sides;

(iii) a transverse seal extending across the width of the package at each of the opposed ends;

(iv) a pair of overlying flaps extending outwardly from said longitudinal seal and lengthwise between the opposed ends, the overlying flaps having facing inner surfaces and outer free edges; and (c) the finger wiping patch comprising a textured surface selected from the group consisting of foaming ink, absorbent resins, tacky resins, and textured material being applied to the wrapper at a position outside the product wrapper, the finger wiping patch being covered to prevent exposure to contaminants, the textured surface being applied to at least some portion of the inner surface of at least one of the overlying flaps, wherein the composition forms the finger wiping patch which is accessible to a consumer of the product beneath the flaps.

7. The package of claim 6 wherein the package further comprises opposed side edges and wherein a tear strip is formed in at least one of the opposed side edges of the package.

8. The package of claim 6 wherein the package portion and the pair of overlying flaps are formed from a single sheet of flexible material.

9. The package of claim 6 wherein the flexible sheet material is selected from the group consisting of polypropylene, cellophane, polyester, and combinations thereof.

10. The package of claim 9 wherein the flexible sheet material comprises an inner surface having a metallized layer affixed thereto at least some portion of the inner surface.

* * * * *